US005299969A

United States Patent [19]

Zaruba

[11] Patent Number: 5,299,969

[45] Date of Patent: Apr. 5, 1994

[54] LOOP FEATURE FOR PROPELLED TOY VEHICLES

[75] Inventor: John V. Zaruba, Oak Park, Ill.

[73] Assignee: Breslow, Morrison, Terzian & Associates, Inc., Chicago, Ill.

[21] Appl. No.: 10,642

[22] Filed: Jan. 28, 1993

[51] Int. Cl.[5] ..... A63H 18/14

[52] U.S. Cl. ..... 446/429; 446/444; 238/10 R; 238/10 C

[58] Field of Search ..... 446/429, 430, 444, 445, 446/446, 447, 431; 238/10 R, 10 A, 10 B, 10 C, 10 E, 10 F; 273/86 B

[56] References Cited

U.S. PATENT DOCUMENTS

| | | | |
|---|---|---|---|
| 2,416,473 | 2/1947 | Fields | 446/429 X |
| 2,756,687 | 7/1956 | Fields | 446/444 X |
| 3,209,491 | 10/1965 | Roeper | 446/444 X |
| 3,641,704 | 2/1972 | Sims et al. | 446/429 |
| 4,969,851 | 11/1990 | Rasmussen | 446/444 |

OTHER PUBLICATIONS

Marchon Catalog p. 33 (1990).
Mattel Catalog p. 27 (1991).
Tyco Catalog p. 43 (1991).
Tomy Catalog p. 25 (1991).
Tomy Catalog p. 27 (1991).

*Primary Examiner*—Mickey Yu
*Attorney, Agent, or Firm*—Dick and Harris

[57] ABSTRACT

A loop feature for propelled toy vehicles includes a generally vertically oriented single loop having a movable ingress portion and a movable egress portion. A propelled toy vehicle enters the loop upon engaging one surface of the ingress portion. Player-operable controls effect movement of the egress portion to permit the propelled toy vehicle to exit the loop. Both movable portions have a free end and a connected end. The connected end of each movable portion is hingedly connected to each end of a fixed arcuate portion. Within the loop there is provision for propelling the toy vehicle as it continues to go around the loop.

15 Claims, 1 Drawing Sheet

LOOP FEATURE FOR PROPELLED TOY VEHICLES

BACKGROUND OF THE INVENTION

1. Field of the Invention

This invention relates generally to features for enhancing the enjoyment and play value of propelled toy vehicles and more particularly to a generally vertically oriented loop feature for propelled toy vehicles.

2. Background Art

Toy vehicles, and in particular propelled toy vehicles, have long been popular playthings; their enjoyment and play value has been enhanced by various features such as obstacles over which propelled toy vehicles clamber and track layouts around which propelled toy vehicles race. A feature that is particularly entertaining and exciting is a generally vertically oriented loop around which a propelled toy vehicle proceeds in apparent defiance of gravity. Generally such loop features are part of a track layout such as for electrically powered slot car racers or track layouts for freewheeling vehicles that are propelled by gravity or mechanical launching devices. However, a vertical loop feature could as well be used in association with a propelled toy vehicle in the absence of a track layout.

Generally, vertically oriented loops have utilized non-aligned entrances and exits such that the loop is not a complete loop but is instead a portion or turn of a spiral. One disadvantage of such spiral turns is that the number of revolutions that the propelled toy vehicle can make is limited to the number of turns of the spiral that have been provided. Aside from the cost and space requirements for such additional turns of the spiral, there is the additional disadvantage that the player does not have any control over the number of revolutions that will be made with the propelled toy vehicle.

In Rasmussen U.S. Pat. No. 4,969,851 issued Nov. 13, 1990, a trackway segment is disclosed for facilitating flipping over of a propelled toy vehicle. The trackway segment includes an arc forming a curved ramp and a lower curved section mounted for pivotal movement relative to the curved ramp. The lower curved section is manually movable between a lower position where it permits the toy vehicle to enter the curved ramp and an upward position in which the toy vehicle will pass beneath it and bypass entering the curved ramp. However, the curved ramp of Rasmussen is specifically designed to flip the toy vehicle over by terminating the curved ramp far short of completing a loop. There remains a need for a generally vertically oriented single loop around which a propelled toy may complete a selected number of loops and then exit the loop.

SUMMARY OF THE INVENTION

The present invention is concerned with providing a generally vertically oriented single complete loop around which a propelled toy vehicle may complete a selected number of loops before exiting the loop. Relatively movable ingress and egress portions provide for the propelled toy vehicle to enter and exit the loop. Player-operable controls are provided for determining the number of loops that the propelled toy vehicle will complete. Power is provided to propel the toy vehicle as it continues to go around to loop.

BRIEF DESCRIPTION OF THE DRAWINGS

For a better understanding of the present invention, reference may be had to the accompanying drawings in which.

DETAILED DESCRIPTION

Figure 1:
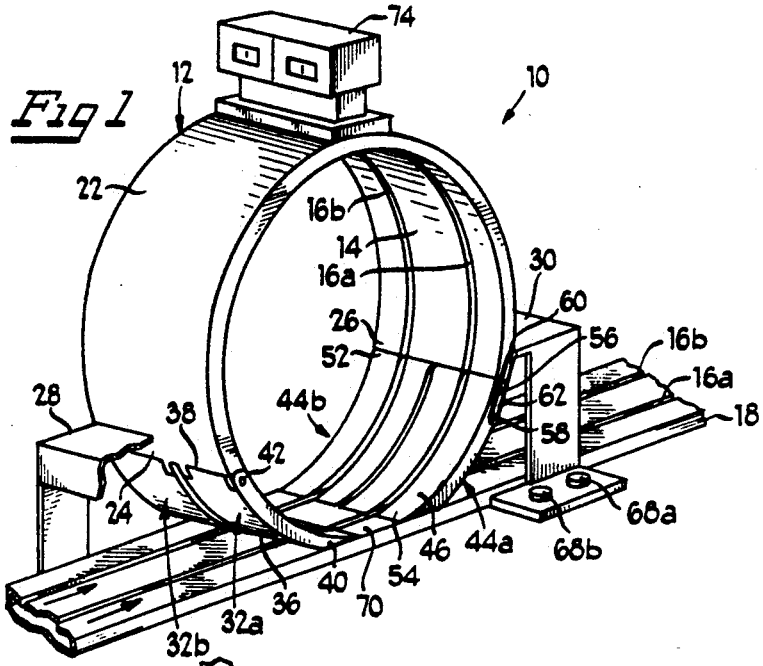
FIG. 1 is a front perspective view of a loop feature embodying the present invention.

Referring now to the drawings in which like parts are designated by like reference numerals throughout the several views, there is shown in FIG. 1 a loop feature 10 for an electrically propelled slot car track layout. The loop feature includes an approximately 360° generally circular single complete loop 12 for a side-by-side double track layout. Thus, loop 12 has an inner track surface 14 which includes generally parallel slots **16*a* and 16*b* which cooperate with corresponding and aligned slots in a generally flat, straight trackway segment 18**.

The generally parallel slots are powered by an electrical power source with separate controls (not shown) for each slot in a conventional manner. Conventional toy slot cars such as vehicle 20, illustrated in broken line in FIGS. 2 and 3, receive power from the track layout as they traverse the track layout through electrical contacts with the track. Propelled slot car 20 may go around the entirety of loop 12 for as many revolutions as the vehicle has sufficient power and the player selects.

Part of complete loop 12 is formed by a fixed curved portion 22 which, in the embodiment shown, encompasses more than 180° of the entire 360° loop and has opposed ends 24 and 26. A pair of trackway segment bridging brackets 28 and 30 substantially fixedly support portion 22 with respect to trackway segment 18 and the playing surface upon which the trackway segment is mounted. Bridging brackets 28 and 30 are generally "U"-shaped with the bight portion attached to fixed curved portion 22 and the free ends mounted on trackway segment 18 and/or the surface upon which the trackway segment is mounted.

Single complete loop 12 includes a pair of side-by-side curved ingress portions **32*a* and 32*b* which are generally parallel to each other. Curved ingress portions 32*a* and 32*b* are substantially identical in construction and hence further details will only be described for one of them. Each curved ingress portion has a concave surface 34 and convex surface 36. In addition, each curved ingress portion has a connected end 38 and an opposed free end 40. Connected end 38 is mounted adjacent end 24 of portion 22 to fixed portion 22 by ingress hinge pin 42 so that curved ingress portion 32 is mounted for pivotal movement relative to fixed portion 22 about the axis of hinge pin 42**.

Complete loop 12 also has a pair of side-by-side curved egress portions **44*a* and 44*b*** that are generally parallel to each other. As with the ingress portions, egress portions 44*a* and 44*b* are substantially identical to each other and hence details of them will only be described to one of them. Each curved egress portion has a concave surface 46 and an opposed convex surface 48. Extending outwardly from, and generally centrally disposed with respect to, convex surface 48 is a fin 50. In addition, each curved egress portion has a connected end 52 and an opposed free end 54. The connected end of each egress portion is mounted adjacent end 26 of fixed portion 22 by an egress hinge pin 56. Thus, each curved egress portion 44 is mounted for pivotal movement relative to fixed portion 22 about the axis of egress hinge pin 56.

Figure 2:
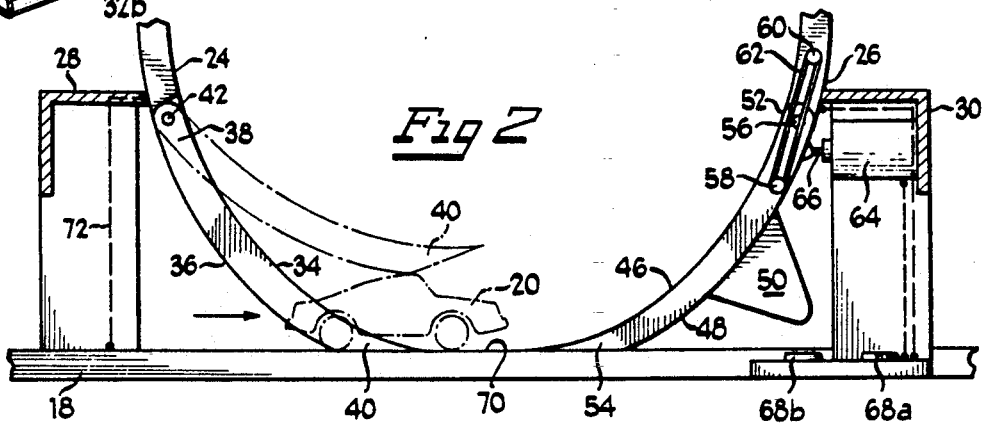
FIG. 2 is an enlarged scale, fragmentary, front elevational view, partially in section, of the loop feature shown in FIG. 1.

As shown in the enlarged scale drawing of FIG. 2, there is an outwardly laterally extending peg 58 on the egress portion spaced from egress hinge pin 56 toward free end 54. There is also an outwardly laterally extending peg 60 on fixed portion 22 adjacent to end 26 but spaced toward the center of the arc of fixed curved portion 22. An elastic band 62 extends from peg 58 to peg 60 and also goes around egress hinge pin 56.

Conveniently housed adjacent the bight portion of bracket 30 are a pair of independently operated solenoids 64 each having a plunger 66 (only one of which is shown for ease of illustration). Each of solenoids 64 is operatively disposed so that its plunger 66 engages convex surface 48 of a respective one of the curved egress portions adjacent its respective connected end 52. A player-operable switch button 68*a* or 68*b* controls each of the solenoids which is powered by the same source (not shown) as the track.

A relatively short portion 70 of trackway segment 18 forms a second fixed portion of single complete loop 12. Each of the free ends of the curved ingress portions and curved egress portions are formed at an angle, which is best shown in FIG. 2, so that there is a smooth transition with portion 70.

Fixed portion 22, together with fixed portion 70, curved ingress portions 32*a* and 32*b* plus curved egress portions 44*a* and 44*b*, in their respective positions as shown in FIG. 1, form single complete loop 12. Accordingly, a propelled toy vehicle 20 going around inner surface 14 of single complete loop 12 will move from concave surface 34 of a curved ingress portion across its free end 40, across short fixed portion 70, and then across free end 54 of a curved egress portion and then along its concave surface 46 and into curved fixed portion 22. As an alternative, the respective free ends of the curved ingress portions and the curved egress portions may be positioned in substantially abutting relationship so as to eliminate the need for any short fixed portion.

Bracket 28 carries electrical connections 72 between trackway segment 18 and fixed portion 22 to provide power to the electric slot cars as they go around the loop, more particularly fixed portion 22. The relatively short distances that the propelled toy vehicle is without power as it traverses the curved ingress portion and the curved egress portion does not stop the toy vehicle from going around the loop.

Each of the curved ingress and curved egress portions are movable from their respective closed position shown in FIG. 1 to an open position. The curved ingress portions are generally maintained in their closed provisions by the force of gravity as well as the weight of the propelled toy vehicle as it moves over concave surface 34. A propelled toy vehicle 20 moving along trackway segment 18 in the direction of the arrows illustrated in FIGS. 1 and 2 will impact upon convex surface 36 of a curved ingress portion causing the curved ingress portion to pivot upwardly and inwardly toward the center of loop 12 to the open position illustrated in phantom line in FIG. 2. Vehicle 20 will then proceed along short fixed portion 70 and across free end of the curved egress portion and onto its concave surface 46 and then into curved fixed portion 22.

Once the propelled toy vehicle passes under the curved ingress portion which has been moved by the impact of the vehicle from the closed position of the curved ingress portion in which it forms part of the closed loop to the open position in which the curved egress portion is displaced from and interrupts the loop, the curved ingress portion will pivot under the bias of gravity back down into its closed position. As the propelled toy vehicle continues to go around the single complete loop its weight and impact upon concave surface 34 will, together with the bias of gravity, maintain free end 40 in contact with short fixed portion 70.

Figure 3:
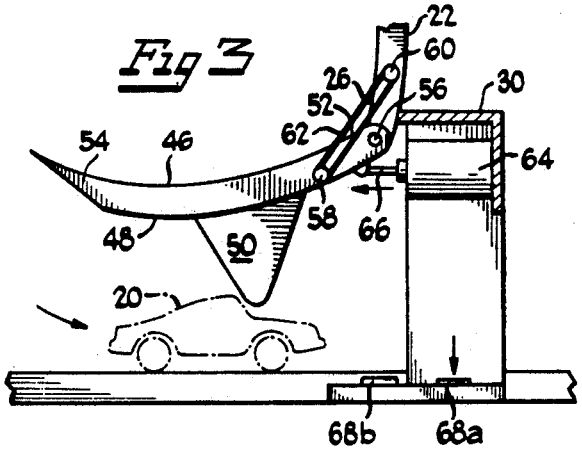
FIG. 3 is an enlarged scale, fragmentary, front elevational view, partially in section, of the loop feature shown in FIG. 1 while a propelled toy vehicle is exiting the loop.

When a solenoid is actuated by a player depressing the respective switch button, plunger 66 will extend in the direction of the arrow illustrated in FIG. 3 and pivot the curved egress portion about the axis of hinge pin 56 from the closed position illustrated in FIG. 2 in which the curved egress portion forms part of complete loop 12 to the open position illustrated in FIG. 3 in which the curved egress portion is displaced from and interrupts the loop to permit propelled toy vehicle 20 to exit the loop. As the propelled toy vehicle exits the loop, the vehicle engages fin 50 projecting from convex surface 48 of the curved egress portion causing the curved egress portion to pivot back downwardly a sufficient distance for the over-center bias of elastic band 62 to the return curved egress portion to the closed position in which free end 54 abuts short fixed portion 70.

Although, like curved ingress portion 32, curved egress portion 44 is biased to its closed position by the force of gravity, the additional bias of elastic band 62, or some other bias such as an over-center spring, is preferred to help maintain the free end of the curved egress portion in contact with short fixed portion 70. An additional bias has been found helpful to assist in returning free end 54 down into contact with the short fixed portion after a toy vehicle has exited the closed loop so that the next time a propelled toy vehicle enters the loop the vehicle does not encounter any discontinuity and may easily cross free end 54 and go onto concave surface 46. A discontinuity between free end 40 of the curved ingress portion and portion 70 is not as critical since the propelled toy vehicle is coming down the concave surface of the curved ingress portion and helps bias it into contact with portion 70.

Disposed atop fixed portion 22 is a lap counter 74 that may be of conventional design such as the Tyco 440-Pro Lap Counter (1991 Catalog No. 6785). If desired, a lap counter may be connected to the solenoids to open a curved egress portion upon a propelled toy vehicle completing a preselected number of laps around the loop.

Figure 4:
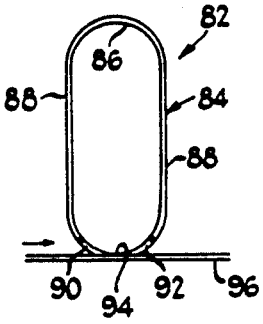
FIG. 4 is a reduced scale, front elevational view of another embodiment of the present invention.

FIG. 4 shows a vertically elongated single complete loop 82 for electric slot cars. In this embodiment, the single complete loop includes a fixed portion 84 that not only has a section 86 that encompasses 180° of curvature but also has two generally vertically disposed straight sections 88. Single complete loop 82 also includes a curved ingress portion 90, a curved egress portion 92 and a short fixed portion 94 between the respective free ends of the ingress and egress portions. Fixed portion 94 is part of a trackway segment 96 with respect to which portion 84 is substantial fixedly mounted by brackets (not shown). Further details of the various portions are essentially identical to those previously described with respect to single complete loop 12.

Figure 5:
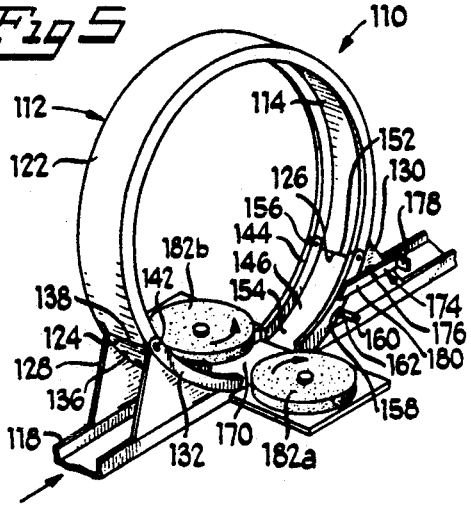
FIG. 5 is a front prospective view of yet another embodiment of the invention.

FIG. 5 illustrates yet another embodiment of the present invention, more particularly one for free wheeling toy vehicles that are propelled by gravity or one or more mechanical devices which contact and impel the vehicle at the onset of its run and possibly at periodic intervals before the end of its run. Thus, there is shown in FIG. 5 a loop feature 110 having a single complete loop 112 with an inner surface 114 that a propelled free wheeling toy vehicle may go around the entirety of for as many revolutions that a player selects and the propelled toy vehicle has sufficient power. As in the previous embodiments, single complete loop 112 cooperates with a generally straight trackway segment 118.

Loop 112 includes a substantially fixed portion 122 which encompasses more than 180° of curvature and has opposed ends 124 and 126. A pair of trackway bridging brackets 128 and 130 support portion 122 in a substantially fixed relationship with respect to trackway segment 118. A curved ingress portion 132 has a concave surface (not shown) which the propelled toy vehicle traverses and an opposed convex surface 136. Curved ingress portion 132 also has a connected end 138 and a free end (not shown). As in previous embodiments, curved ingress portion 132 is mounted to end 124 of fixed portion 122 for relative pivotal movement about the access of a hinge pin 142.

Complete loop 112 also includes a curved egress portion 144 having a concave surface 146 and an opposed convex surface (not shown). In addition, curved egress portion 144 has a connected end 152 and a free end 154. The curved egress portion is mounted adjacent end 126 of fixed portion 122 for pivotal movement relative to fixed portion 122 about the access of a hinge pin 156. Extending laterally outwardly from curved egress portion 144 and from trackway segment 118 are pegs 158 and 160, respectively. An elastic band 162 is stretched from peg 158 to 160. A short fixed portion 170 of trackway segment 118 between the free ends of curved ingress portion 132 and curved egress portion 144 also forms part of complete loop 112.

Thus, as in the embodiment of FIGS. 1-3, curved ingress portion 132 is pivotable from its closed position shown in FIG. 5 in which it forms part of the complete loop and an open position in which it is displaced from and interrupts the loop to permit a propelled toy vehicle to enter the loop in the manner described above with respect to the embodiment of FIGS. 1-3. Curved ingress portion 132 is biased by gravity and assisted by the traversing of its concave surface by a propelled toy vehicle going around the loop to return from the open position to the closed position.

Curved egress portion 144 is pivotable from its closed position illustrated in FIG. 5 in which it forms part of the complete loop to an open position (similar to that illustrated in FIG. 3) in which curved egress portion 144 is displaced from and interrupts the loop to permit the propelled toy vehicle to exit the loop. In order to move curved egress portion 144 from its closed position to an open position, a pivoting lever 174 is mounted for pivotal movement about a fulcrum pin 176 on bracket 130. Lever 174 has a player actuating end 178 and an opposed end 180. As a player pushes down upon actuator end 178 causing lever 174 to pivot in a clockwise direction, opposed end 180 will cause curved egress portion 144 will pivot about the axis of hinge pin 156 from the closed position to the open position against the bias of elastic band 162. Once the propelled toy vehicle exits the loop and the player releases actuator end 178, gravity and the bias of stretched elastic band 162 will return curved egress portion 144 to its closed position again forming part of the complete loop.

Disposed on either side of short fixed portion 170 are a pair of spaced apart soft foam counterrotating wheels or discs **182*a* and 182*b*. The counterrotating wheels are powered by an electric motor (not shown) or by a player operated crank (not shown) in a conventional manner. Wheels 182 counterrotate such that a vehicle proceeding initially in the direction of the arrow illustrated in FIG. 5 and entering loop 112 after impacting convex surface 136 of curved ingress portion 132 will move into the space between wheels 182** and be contacted by the edges of the wheels to propel the vehicle around the loop. Accordingly, the propelled toy vehicle will continue to go around the loop passing through the counterrotating wheels which propel the toy vehicle as it goes around the loop until such time as the curved egress portion is moved to the open position and the vehicle exits the loop.

The present invention, in a form similar to that illustrated in FIG. 5, but without the counter rotating wheels, may also be used with a toy vehicle that is propelled by means of a self contained battery or spring powered motor. While particular embodiments of the present invention have been shown and described, further variations and modifications will occur to those skilled in the art. It is intended in the appended claims to cover all such variations and modifications as fall within the true spirit and scope of the present invention.

What is claimed is new and desired to be secured by Letters Patent is:

1. A generally vertically oriented loop feature for a propelled toy vehicle comprising in combination:

a single complete loop having an inner surface upon which the propelled toy vehicle may go around the entirety of the loop for as many revolutions as the propelled toy vehicle has sufficient power;

a substantially fixed, curved portion of the complete loop;

the fixed portion having opposed ends;

a curved ingress portion adjacent one of the opposed ends and a curved egress portion adjacent the other of the opposed ends;

the ingress portion being movable between a closed position in which the ingress portion forms part of the complete loop and a open position in which the ingress portion is displaced from and interrupts the complete loop to permit the propelled toy vehicle to enter the loop;

the egress portion being movable between a closed position in which the egress portion forms part of the complete loop and a open position in which the egress portion is displaced from and interrupts the loop to permit the propelled toy vehicle to exit the loop.

2. The loop feature of claim 1 including:

means biasing the ingress portion to return to the closed position from the open position.

3. The loop feature of claim 1 in which:

the ingress portion has a connected end and a free end;

the connected end being mounted adjacent one end of the fixed portion for pivotal movement relative to the fixed portion;

the ingress portion has a concave surface which the propelled toy vehicle traverses and an opposed convex surface;

the ingress portion being movable from the closed position to the open position upon the propelled toy vehicle impacting upon the convex surface.

4. The loop feature of claim 1 in which:

the ingress portion has a connected end and a free end;

the connected end being mounted adjacent one end of the fixed portion for pivotal movement relative to the fixed portion;

the egress portion has a connected end and a free end;

the connected end of the egress portion being mounted adjacent the other end of the fixed portion for pivotal movement relative to the fixed portion.

5. The loop feature of claim 4 including a second fixed portion of the complete loop disposed between the free ends of the ingress portion and the egress portion when each of the ingress portion and egress portion are in their respective closed positions.

6. The loop feature of claim 1 including player-operable controls for moving the egress portion from the closed position to the open position.

7. The loop feature of claim 6 including means biasing the egress portion to return to the closed position from the open position.

8. The loop feature of claim 6 including means for effecting movement of the egress portion from the open position to the closed position upon impact by the propelled toy vehicle.

9. The loop feature of claim 8 in which:

the egress portion has a concave surface which the propelled toy vehicle traverses and an opposed convex surface;

the means for effecting movement includes a tab extending outwardly from the convex surface.

10. The loop feature of claim 1 in which the ingress portion and the egress portion are mounted for pivotal movement relative to the fixed portion.

11. The loop feature of claim 1 in which the fixed curved portion encompasses at least 180° of curvature.

12. The loop feature of claim 1 including means for propelling the toy vehicle as it goes around the loop.

13. The loop feature of claim 12 in which the means includes a rotating wheel that contacts the toy vehicle as it goes around the loop.

14. The loop feature of claim 13 in which the rotating wheel is positioned between the respective free ends of the ingress portion and the egress portion.

15. The loop feature of claim 12 in which:

a second fixed portion of the complete loop is disposed between the free ends of the ingress portion and the egress portion when each of the ingress portion and the egress portion are in their respective closed portions;

the means for propelling includes a pair of spaced apart counterrotating wheels; and each one of the pair of wheels is disposed on an opposite side of the second fixed portion.

* * * * *